US005289948A

United States Patent [19]

Moss et al.

[11] Patent Number: 5,289,948

[45] Date of Patent: * Mar. 1, 1994

[54] SQUEEZE BOTTLE APPARATUS WITH FORCE MULTIPLYING PISTONS

[75] Inventors: Owen R. Moss, Cary, N.C.; Norman R. Gordon; Henry S. DeFord, both of Kennewick, Wash.; Eugene A. Eschbach, Richland, Wash.

[73] Assignee: Battelle Memorial Institute, Richland, Wash.

[ * ] Notice: The portion of the term of this patent subsequent to Nov. 27, 2007 has been disclaimed.

[21] Appl. No.: 862,908

[22] Filed: Apr. 3, 1992

Related U.S. Application Data

[63] Continuation-in-part of Ser. No. 596,848, Oct. 12, 1990, Pat. No. 5,129,550, which is a continuation-in-part of Ser. No. 300,601, Jan. 23, 1989, Pat. No. 4,972,977.

[51] Int. Cl.[5] ..... B65D 37/00

[52] U.S. Cl. ..... 222/135; 222/145; 222/207; 239/327

[58] Field of Search ..... 222/135, 137, 145, 207, 222/209, 211, 249, 378, 212, 409; 239/327

[56] References Cited

U.S. PATENT DOCUMENTS

| | | | |
|---|---|---|---|
| 3,255,933 | 6/1966 | Martin | 222/212 |
| 3,330,444 | 7/1987 | Raypholtz | 222/145 |
| 4,603,794 | 8/1986 | De Ford et al. | 222/211 |
| 4,972,977 | 11/1990 | Moss et al. | 222/211 |
| 5,129,550 | 7/1992 | Esbach | 222/145 |

*Primary Examiner*—David M. Mitchell
*Assistant Examiner*—Philippe Derakshani
*Attorney, Agent, or Firm*—Paul W. Zimmerman

[57] ABSTRACT

The present invention comprises a spray bottle in which the pressure resulting from the gripping force applied by the user is amplified and this increased pressure used in generating a spray such as an aerosol or fluid stream. In its preferred embodiment, the invention includes a high pressure chamber and a corresponding piston which is operative for driving fluid out of this chamber at high pressure through a spray nozzle and a low pressure chamber, and a corresponding piston which is acted upon by the hydraulic pressure within the bottle resulting from the gripping force. The low pressure chamber and piston are of larger size than the high pressure chamber and piston. The pistons are rigidly connected so that the force created by the pressure acting on the piston in the low pressure chamber is transmitted to the piston in the high pressure chamber where it is applied over a more limited area, thereby generating greater hydraulic pressure for use in forming the spray.

9 Claims, 7 Drawing Sheets

SQUEEZE BOTTLE APPARATUS WITH FORCE MULTIPLYING PISTONS

RELATED U.S. APPLICATION DATA

This application is a continuation-in-part of prior application Ser. No. 07/596,848, filed Oct. 12, 1990, now issued as No. 5,129,550 on Jul. 14, 1992, which is a continuation-in-part of application Ser. No. 300,601, filed Jan. 23, 1989, now issued as No. 4,972,977.

BACKGROUND OF THE INVENTION

The present invention relates to devices for dispensing fluids and, more particularly, to squeeze bottles designed to provide sprays of fluid and fluidized materials.

The high pressures which can be provided by chemical propellants including but not limited to hydrofluorocarbons, chlorofluorocarbons, fluorocarbons, and hydrocarbons propellants have been usefully employed in generating finely divided aerosol sprays that are relatively uniform in consistency and that are produced with little effort on the part of the user. However, in recent years the use of chemical propellants for powering aerosol dispensers has become a matter of concern as the environmental effects of such compounds have become clear. Consequently, it has become important to develop alternative methods of generating aerosol and other types of sprays.

Unfortunately, most mechanically operated spray bottles do not allow significant amounts of fine spray to be generated without application of substantial gripping force by the user. Thus, if the user does not have the ability to apply a substantial force, it is not possible for him to produce a satisfactory spray. Furthermore, the difficulties inherent in applying a steady force to conventional squeeze bottle embodiments often result in non-uniform or coarse spray patterns along with sputtering of the fluid.

It is therefore an object of the present invention to provide an improved spray bottle apparatus that is capable of dispensing significant amounts of a fluid stream or a finely divided spray in uniform patterns.

It is another object of the present invention to provide an improved spray bottle mechanism that amplifies the pressure resulting from the gripping force applied by the user, and which employs the increased pressure so derived in generating a satisfactory spray.

It is a further object of the present invention to provide an improved dispensing pump for a spray bottle which is operative for developing a mechanical advantage when in use, which allows for the amplification of the available hydraulic pressure.

It is yet another object of the present invention to provide an improved spray bottle which can be easily utilized by all types of users regardless of their gripping strength, and which generates either a satisfactory aerosol spray or the mixing of disparate fluids upon the application of a limited amount of gripping force by the user.

It is a yet further object of the present invention to provide an improved spray bottle mechanism which is relatively simple in design, economical to construct, reliable in service, and which can serve as an effective alternative to aerosol cans using chemical propellants.

SUMMARY OF THE INVENTION

The present invention relates to a system for generating a spray of a fluid material held within a sealed container constructed of a resilient material by "stepping up" the pressure produced within the container when it is manually squeezed and using the increased pressure so produced in generating the spray. The invention comprises a dispensing pump which is mounted on the container, including a housing defining two separate chambers and a hydraulic assembly having a pair of fluid displacers which operate within these chambers. One fluid displacer is of comparatively large diameter and this fluid displacer is driven in its corresponding chamber by the pressure within the container while the chamber itself is vented to the atmosphere. The other fluid displacer is of comparatively small diameter and is structurally connected to the larger fluid displacer so as to be driven by the force generated by the pressure acting on the net area of the large fluid displacer. The chamber corresponding to the small fluid displacer is associated with valve and fluid supply mechanisms which allow for fluid to be driven out of this chamber under increased pressure when the container is squeezed, and for fluid to be charged into this chamber as the container recovers from being squeezed and resumes its original shape.

The operation of the fluid displacers within their corresponding chambers results in the hydraulic pressure within the container being amplified and applied to a charge of fluid within the small chamber which can then be driven out through the nozzle at high pressure and efficiently ejected, thereby producing a "media" of the fluid such as an aerosol spray or fluid stream.

In the preferred embodiment, the chambers are coaxially aligned and the fluid displacers comprising the hydraulic assembly form a single structural unit. The fluid displacers displace fluid linearly and may be of any type, including but not limited to pistons and bellows. Fluid is supplied to the smaller chamber by way of a conduit through the hydraulic assembly and a fluid supply tube, which extends down into the fluid residing in the container. Fluid flow is controlled by two check valves. The first check valve is mounted between the smaller chamber and the nozzle, and the second check valve is mounted between the supply tube and the fluid within the container. This arrangement provides for a particularly compact and efficient design allowing the dispensing pump to be conveniently mounted within the neck of the container holding the fluid to be ejected.

The subject matter of the present invention is particularly pointed out and distinctly claimed in the concluding portion of this specification. However, both the organization and method of operation, together with further advantages and objects thereof, may best be understood by the reference to the following description taken in connection with accompanying drawings wherein like reference characters refer to like elements.

DETAILED DESCRIPTION OF THE INVENTION

Figure 3:
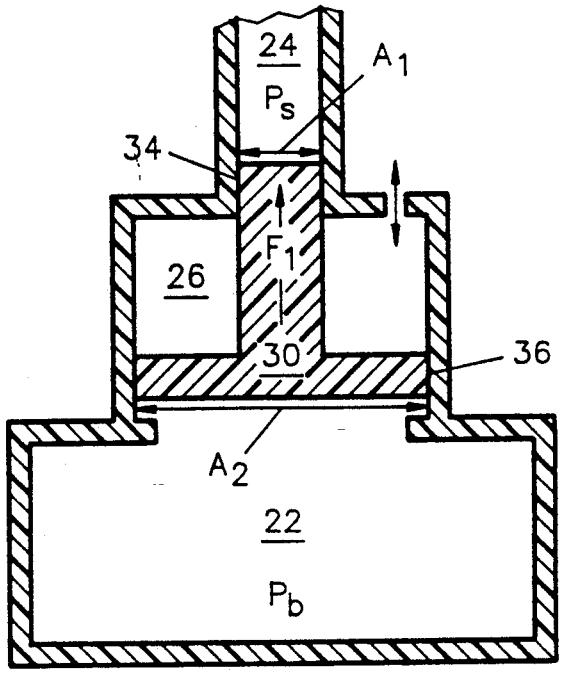
FIG. 3 is a diagrammatic cross-sectional view of a simplified model of the present invention whereby the operation of the invention can be conveniently explained with reference to static conditions.

Referring now to FIG. one embodiment of the present invention is shown in the form of the spray bottle (10) comprising a deformable and resilient container (12) and a dispensing pump (14) mounted on this container for producing an aerosol type spray of liquid (5) resident within the interior (22) of the container (12).

The container (12) is constructed of any deformable and resilient material, but is preferably a plastic, such as a polyethylene, that can be readily deformed by hand pressure, and rapidly return to its original shape when such hand pressure is released. The dispensing pump (14) is designed for being secured within the neck (15) of the container (12) and extends from above the top of the container (12) down toward the bottom of the interior (22) of the container (12).

It is preferred that deformation of the container (12) should not greatly alter the orientation of the dispensing pump (14) and, hence, the direction of the resulting spray. Orientation of the dispensing pump (14) may be controlled in several ways. It is preferred that the container (12) have a stiff portion and a resilient portion proportioned and arranged to permit deformation of the resilient portion while preserving an orientation of the dispensing pump (14). Specifically, the dimensions and proportions of the container (12), neck (15), and shoulder (16), comprises a neck (15) that is stiffer than the fluid-containing portion of the container (12). The neck (15) may be stiffened by providing a thicker wall than the fluid-containing portion of the container (12). Alternatively, the neck (15) may be made of a material having a higher elastic modulus than the fluid-containing portion of the container (12).

Another embodiment for preserving orientation of the dispensing pump (14) comprises the addition of a stiff portion. Specifically, a guard tube (17) is formed by elongating the housing (20) to extend from the top of the container (12) down toward the bottom of the supply tube (64). The guard tube (17) may also be separate from the housing (20). The guard tube (17) is preferably of a stiffness to resist buckling or substantial deformation under hand pressure. With a guard tube (17), the container (12) is prevented from completely collapsing and buckling under hand pressure, thereby preserving orientation of the dispensing pump (14).

Yet another preferred embodiment wherein orientation of the dispensing pump (14) is preserved upon deformation of the container (12) comprises the use of a bellows for the resilient portion of the container (12). The bellows may be oriented vertically or horizontally with respect to the dispensing pump (14), but is preferably a flat bellows oriented horizontally. A horizontal orientation implies that the bellows deflects horizontally with respect to the dispensing pump (14). A flat bellows is a bellows having a diameter greater than its uncompressed free length.

Figure 2A:
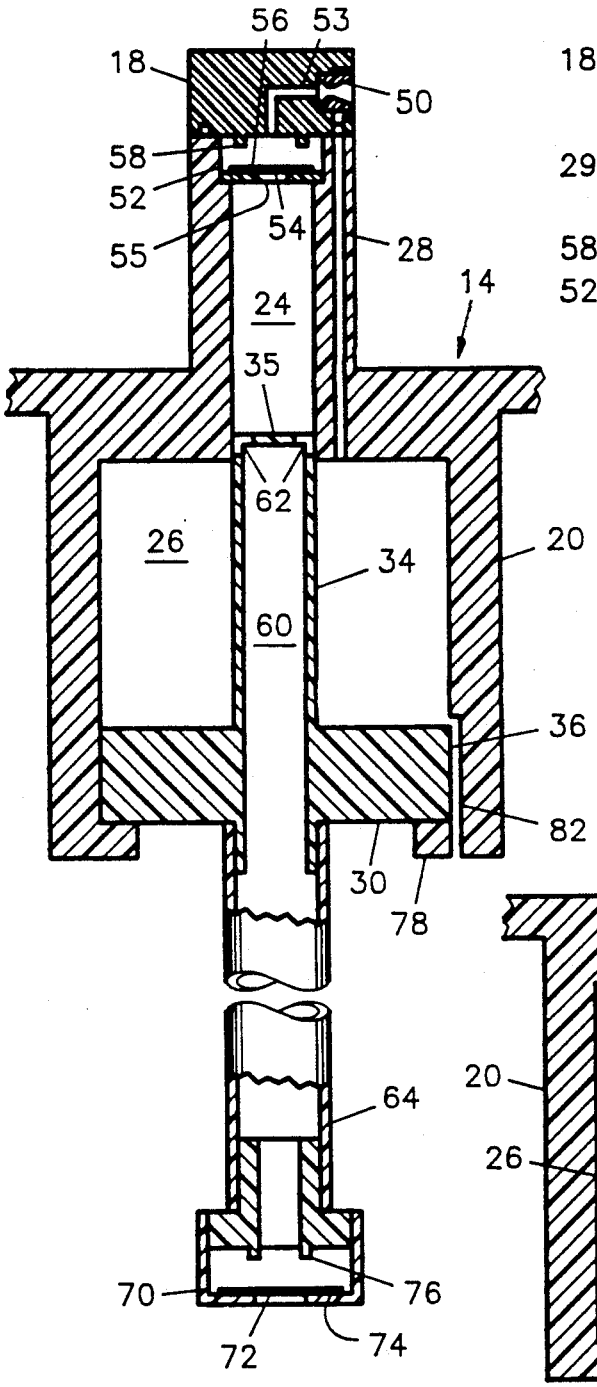
FIG. 2A is a detailed cross-sectional view of the dispensing pump component of the embodiment of the present invention shown in FIG. 1 with the hydraulic assembly element in its starting or rest position prior to the spray bottle being squeezed.
Figure 2C:
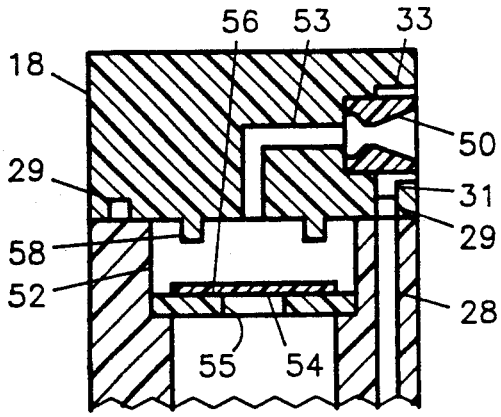
FIG. 2C is a detailed cross-sectional view of the dispensing member component associated with the present invention.
Figure 2B:
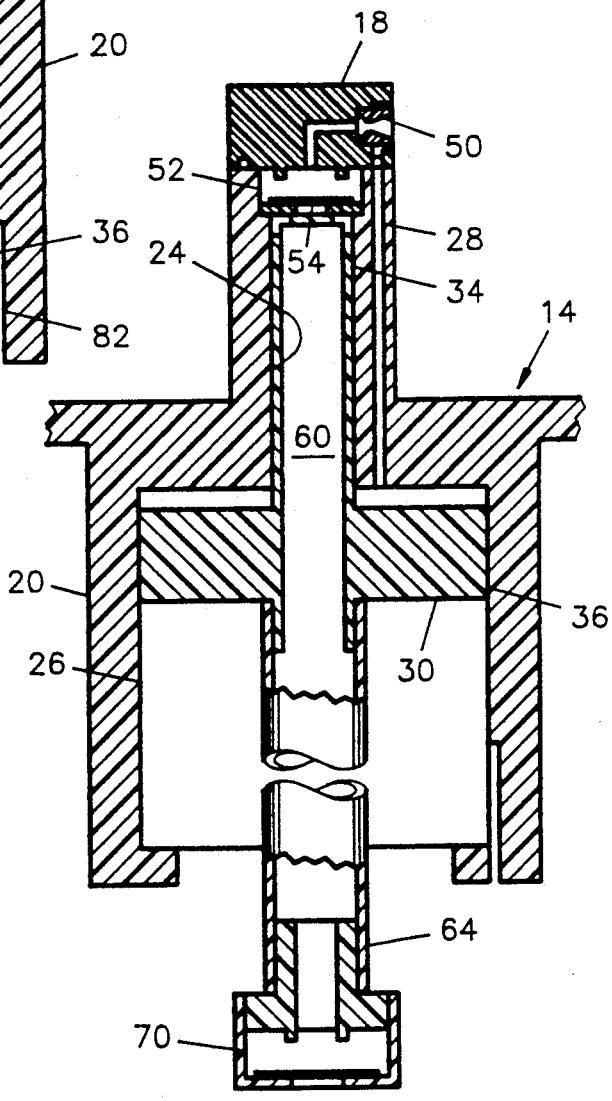
FIG. 2B is a detailed cross-sectional view of the dispensing pump component of the embodiment of the present invention shown in FIG. 1 with the hydraulic assembly element in its end position after the spray bottle has been squeezed.

Referring now to FIGS. 2A, 2B, and also 2C, the dispensing pump (14) is shown in greater detail along with the discharge member (18) associated with it. The dispensing pump (14) includes the housing (20) and the hydraulic assembly (30), the housing (20) defining a high pressure chamber (24) which is cylindrical in shape and a low pressure chamber (26) which also has a cylindrical shape and is coaxially aligned with the chamber (24). The high pressure chamber (24) is of a substantially smaller diameter than the low pressure chamber (26). The high pressure chamber (24) communicates in a controlled manner with the atmosphere exterior to the container (12) through a nozzle (50) in the discharge member (18), while the low pressure chamber (26) communicates with the atmosphere through one or more vent tubes (28) and passages connecting thereto. The hydraulic assembly (30) includes a first fluid displacer (34) designed to operate within the chamber (24), and a second fluid displacer (36) designed to operate within the chamber (26). The fluid displacers (34 and 36) in this embodiment are pistons constructed so as to sealingly engage the interior walls of the chambers (24 and 26), respectively. The first fluid displacer (34) therefore separates and seals off the chamber (24) from the chamber (26) while the second fluid displacer (36) partitions off the interior of the chamber (26) above the second fluid displacer (36) from the interior (22) of the container (12). In accordance with the diameters of the chambers (24 and 26), the first fluid displacer (34) is of substantially lesser diameter than the second fluid displacer (36). Since the first fluid displacer (34) is rigidly connected to the second fluid displacer (36), forces acting on the second fluid displacer (36) are transferred directly to the first fluid displacer (34). In the embodiment shown and described, the fluid displacers (34 and 36) are pistons designed as a single structural unit constituting the hydraulic assembly (30).

The discharge member 18 is mounted on the upper end of the chamber (24) and includes nozzle (50) by means of which liquid may be ejected from the chamber (24) through the action of the first fluid displacer (34) and laterally dispensed from the spray bottle (10).

A check valve (52) is located between the nozzle (50) and the chamber (24). The check valve (52) may be of any type including but not limited to flap valves, ball valves, floating ball valves, or flexible orifice valves. The type of check valve selected may depend upon factors including but not limited to physical factors, for example, pressure intensifier ratio, and economic factors. In a preferred embodiment, the check valve (52) includes a disk-shaped flapper plate (54) mounted between a valve seat (56) and a set of raised bumps or spurs (58) surrounding the passageway (53) to the nozzle (50). The check valve (52) allows one way fluid flow out from the chamber (24) through the nozzle (50) but prevents flow of air through the nozzle (50) into the chamber (24), thereby serving to maintain fluid within the chamber (24).

The hydraulic assembly (30) further includes a conduit (60) in the form of a hollow core extending centrally through the fluid displacers (34 and 36) along the axis on which the pistons are aligned and which is connected to the supply tube (64) at the bottom of the hydraulic assembly (30). The supply tube (64) is constructed of a flexible plastic and extends down toward the bottom of the container (12) projecting into the liquid (5) residing within the container (12). The conduit (60) and supply tube (64) function to allow liquid flow up through delivery vents (62), at the outside edge of the top (35) of the first fluid displacer (34), into chamber (24) from the bottom of container (12). A check valve (70) is mounted on the bottom end of the tube (64) so as to be submerged in the liquid (5) within the container (12). The check valve (70) is similar in construction to the check valve (52) and is mounted on the bottom end of the tube (64) so as to be submerged in the liquid (5) within the container (12). The check valve (70) is similar in construction to the check valve (52) and includes a disk-shaped flapper plate (72) mounted between a valve seat (74) and a set of bumps or spurs (76). The check valve (70) functions to allow fluid flow up through the supply tube (64) and delivery vents (62) into the chamber (24) but prevents any flow of fluid back down from the chamber (24) through the conduit (60) and the tube (64) into the interior (22) of the container (12).

Vent tubes (28) extend up through the housing (20) from the area of the chamber (26) above the second fluid displacer (36) to the atmosphere outside the container (12), and function to allow this part of the chamber (26) to be continuously maintained at atmospheric pressure. A liquid return vent (82) connects the interior of the chamber (26) above the second fluid displacer (36) to the interior (22) of the container (12) when the hydraulic assembly (30) is in its lower most position (as shown in FIG. 2A) in order to allow any stray liquid within the chamber (26) to drain into the interior (22) of the container (12) under the influence of gravity. The retaining ring (78) extends inwardly from the housing (20) below the chamber (26) and functions to prevent the hydraulic assembly (30) from becoming disengaged from the housing (20) during use.

In operation, the hydraulic assembly (30) moves up and down within the housing (20) in response to changes in the pressure level within the container (12). When the user squeezes the spray bottle (10), this action causes the hydraulic pressure within the container (12) to increase by some amount (above gauge pressure) which may on average be in the range of 1 to 4 lb/in. This pressure is applied to the lower surface of the second fluid displacer (36) and exerts a force on the fluid displacer equal to the effective cross-sectional area of the fluid displacer times this pressure. Because the first fluid displacer (34) is rigidly connected to the second fluid displacer (36), the force generated by the hydraulic pressure within the container (12) acting on the second fluid displacer (36) is transmitted through the structure of the hydraulic assembly (30) to the first fluid displacer (34) and is applied to the fluid within the chamber (24). However, this force acts over a more limited area corresponding to the lesser cross-section of the first fluid displacer (34). Since the hydraulic pressure generated within the chamber (24) is equal to the force divided by the area over which it operates, a comparatively high hydraulic pressure is generated within the chamber (24). Fluid may thereby be driven out of the chamber (24) at high pressure through the nozzle (18), and a satisfactory spray such as a finely divided aerosol generated. It should be noted that as fluid is being ejected from the chamber (24) any backward flow of fluid out of the chamber (24) through the vents (62) is prevented by the check valve (70).

As the spray bottle (10) is squeezed, a spray of fluid is continuously generated until the hydraulic assembly (30) fully engages the upper part of the housing as shown in FIG. 2B, and the top (35) of the first fluid displacer (34) seals off the port (55) to the check valve (52). When the user releases his grip on the spray bottle (10) and the container (12) recovers its original shape, the hydraulic assembly (30) is gradually drawn down toward its lower most (starting) position out of engagement with the upper part of the housing (20). During this process, air flows from the atmosphere through the vent tubes (28) into the chamber (26). Meanwhile, liquid material flows up through the check valve (70), supply tube (64), and conduit (60), and finally through delivery vents (62) into the chamber (24), effectively recharging this chamber (24) for the next cycle of spray production which will occur when the spray bottle (10) is again squeezed. It should be noted that as the chamber (24) is being recharged with fluid, any flow of air into the chamber (24) through the nozzle (18) is prevented by the check valve (52).

Referring now specifically to FIG. 2C, the discharge member (18) includes an annular groove (29) which intersects the vent tubes (28) and provides a connecting passageway between vent tubes (28) and the conduit (31) regardless of the alignment of the discharge member (18) with the vent tubes (28). The conduit (31) leads to an annular air discharge channel (33) which surrounds the nozzle (50) and through which comparatively large volumes of air coming out from the chamber (26) may be discharged as fluid is dispensed from the nozzle (50). This air helps to entrain the fluid exiting the nozzle (50) and disperse it.

The principles of operation of the present invention may be explained with reference to the simplified model shown in FIG. 3, which depicts the components of the present invention under static conditions. The pressures within the areas of the chambers (24 and 26) above the fluid displacers (34 and 36), and their relationship to the position of the hydraulic assembly (30), and the pressure within the interior (22) of the spray bottle (10) are the key factors in the operation of the present invention. The pressure $P_b$ within the container (12) of the spray bottle (10) which is generated as a result of the bottle being squeezed, is exerted over a large area corresponding to the diameter of the second fluid displacer (36), resulting in a substantial force $F_1$ being generated. This force $F_1$ is equal to the pressure $P_b$ times the cross-sectional area $A_2$ to the second fluid displacer (36), or $F_1 = P_b A_2$.

However, since little or no counteracting pressures exist within the chamber (26), this entire force $F_1$ is transmitted through the hydraulic assembly (30) and exerted by the first fluid displacer (34) exclusively on the fluid within the chamber (24). This force $F_1$ is applied over a comparatively small area corresponding to the diameter of the first fluid displacer (34), thereby achieving a mechanical advantage, or what in the present case may be termed a "hydraulic advantage". The resulting pressure $P_s$ is equal to the force $F_1$ divided by the cross-sectional area $A_1$ of the first fluid displacer (34) or $P_s=F_1/A_1$. A comparatively large pressure Ps is generated since (by substitution of $P_bA_2$ for $F_1$), $P_s=P_b(A_2A_1)$ and the ratio $A_2A_1$ is large because $A_2>>A_1$. Fluid may thereby be driven out of the chamber (24) under higher pressure $P_s$ through a nozzle, and a highly satisfactory aerosol or fluid stream type spray produced.

Figure 1:
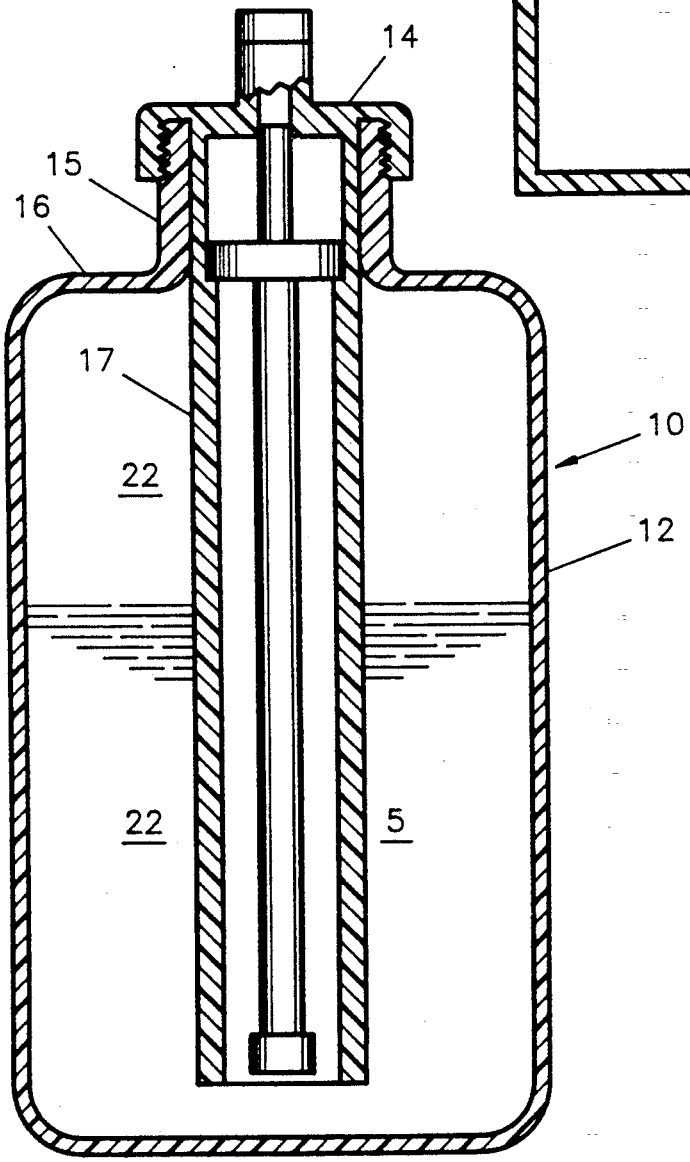
FIG. 1 is an overall cross-sectional view of one embodiment of the present invention showing how the dispensing pump component is installed in a resilient container.

In the actual use of a spray bottle incorporating the present invention such as the spray bottle (10) shown in FIG. 1, the ratio $R_p$ of the pressure within the chamber (24) to the pressure within the bottle (10) may approach the ratio $A_2/A_1$ of the effective areas of the fluid displacers (36 and 34). In the preferred embodiment, the ratio $R_p$ is preferably about 10–15 to so that if the bottle (10) is pressed with a force resulting in two pounds of pressure within the container (12), approximately 20 to 30 lb/in. of pressure may be generated within the chamber (24) for driving the fluid out through the nozzle (50). This phenomenon is very useful since only a limited amount of hand pressure or compressive force is necessary to provide a substantial amount of hydraulic pressure as required for generating a useful spray. Furthermore, since relatively large compressive forces would otherwise be required to generate satisfactory sprays, the present invention allows users having a relatively gentle grip to utilize the spray bottle device. Additionally, the present invention allows a more uniform spray pattern to be produced since pressures above 15 lb/in. which are readily obtainable with the present invention tend to provide more uniform spray patterns regardless of the exact pressure level, and since the modest amount of gripping force required in using the present invention is much easier to apply in a controlled manner.

The parts for the spray bottle (10) of the present invention may be manufactured from a high impact plastic such as polyethylene by conventional injection molding techniques. The proper operation of the dispensing pump (14) requires a good seal between the chambers (24 and 26) and the fluid displacers (34 and 36), respectively. It should be noted that the distance between the delivery vents (62) and the chamber (26) which exists when the hydraulic assembly (30) is in its lower most (starting) position, should not be less than 1–2 mm in order to prevent any undue fluid leakage into the chamber (26). Additionally, the check valves (52 and 70) are designed with sufficient clearance between the flapper plates and the ports into and out of these valves in order to allow relatively unrestricted (forward) flow through the valves.

Figure 4:
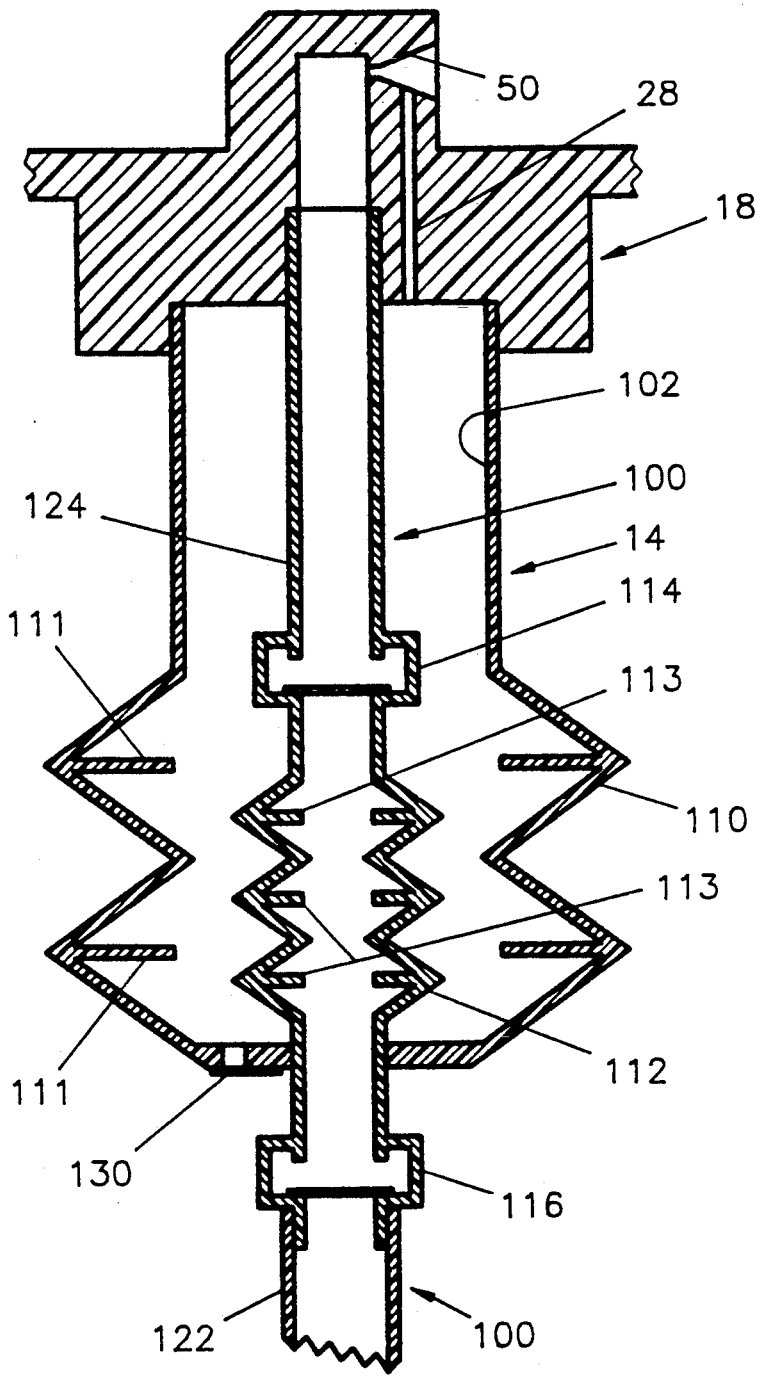
FIG. 4 is a detailed cross-sectional view of the dispensing pump component of an alternative embodiment of the present invention.

Referring now to FIG. 4, an alternative type of dispensing pump (14) in accordance with the present invention, which is suitable for handling a variety of fluids including viscous liquids, is illustrated as attached to a discharge member (18). The discharge member (18) is adapted for being mounted on a deformable and resilient container (12) (not shown in FIG. 4) within which the fluid to be dispensed is held. The discharge member (18) includes the nozzle (50) by means of which fluid from a fluid supply tube (100) which extends down into the fluid resident within the container (12) may be ejected in the form of a media such as a high velocity fluid stream. The discharge member (18) also includes a vent tube (28) which intersects the nozzle (50) and provides a high-volume flow of air up from the cylindrical chamber (102), which may help to entrain the fluid exiting to nozzle (50).

In the dispensing pump (14) of FIG. 4, the fluid displacers (34 and 36) are a large diameter bellows (110) and a small diameter bellows (112) mounted inside of the large bellows (110). The bellows (110 and 112) have a "pleated" shape and are constructed of a resilient material such as neoprene rubber so as to be longitudinally collapsible. The reinforcing rings (111 and 113) are rigid and help maintain the radial shape of the bellows (110) as pressure is applied to them so that they are compressible primarily along their axial dimensions. The small bellows (112) is sized to fit within the bellows (110) and has approximately ⅓ the diameter of the large bellows (112). The small bellows (112) is mounted midway up the fluid supply tube (100) between an upper check valve (114) and a lower check valve (116). The check valves (116 and 114) allow only one-way fluid flow up through the lower portion (122) of the tube (100) into the bellows (112) and from the bellows (112) into the upper portion (124) of the tube (100). The check valves (114 and 116) include flapper plates mounted between valve seats and a set of spurs, and are similar in structure and operation to the check valves (52 and 70) previously described. The bottom end of the large bellows (110) is rigidly affixed to the bottom end of the small bellows (112) so that the bellows (110 and 112) are constrained to expand and contract together in a cooperative fashion. A small check valve (130) is installed on the bottom of the large bellows (110) for allowing stray fluid to drain out of the bellows (110) back into the container (12).

Figure 5:
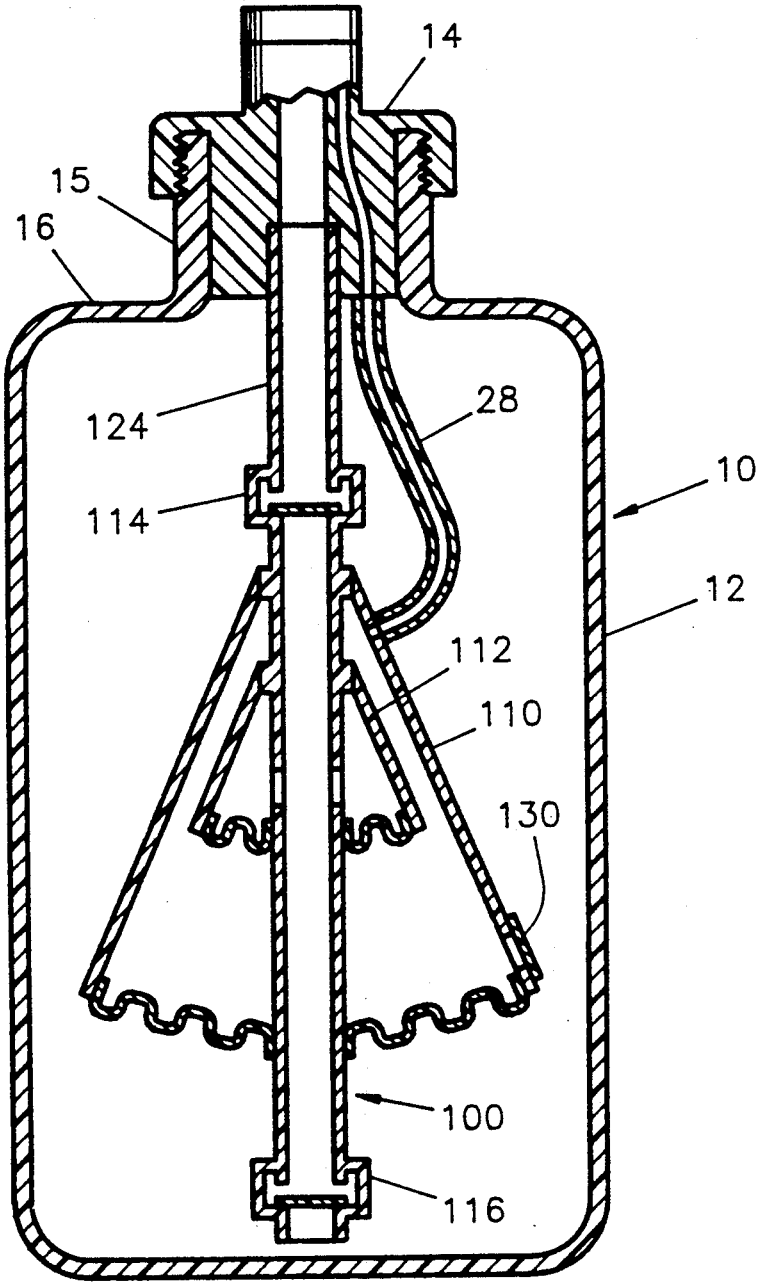
FIG. 5 is a cross-sectional view of an alternative embodiment of the dispensing pump of FIG. 4.

Although FIG. 4, shows cylindrical bellows, non-cylindrical bellows such as blacksmith or organ bellows may also be used as illustrated in FIG. 5. These type of bellows may be especially useful in narrow cross section squeeze bottles including but not limited to nose spray bottles.

In operation, pressure is exerted on the large bellows (110) when the container (12) on which the dispensing pump (14) of FIG. 4 is mounted is squeezed by the user. Since the interior of the bellows (110) and the chamber (102) are exhausted to the atmosphere through the vent (28), the bellows (110 and 112) are both forced upward in unison by the pressure. During this process the small bellows (112) is compressed with all of the force generated by the pressure acting on the bottom of the bellows (110). Consequently, the pressure of the fluid within the bellows (112) is raised to a level approximately equal to the pressure applied to the container (12) times the ratio of the squares of the effective diameters of the bellows (110 and 112). Fluid is driven upward at an elevated pressure through the valve (114), tube (100), and nozzle (50), thereby generating a satisfactory spray. When the container (12) is released and recovers its original shape, the bellows (110 and 112) expand sucking air in through the vent (28) into the interior of the bellows (110) and recharging fluid into the interior of the bellows (112).

Figure 6:
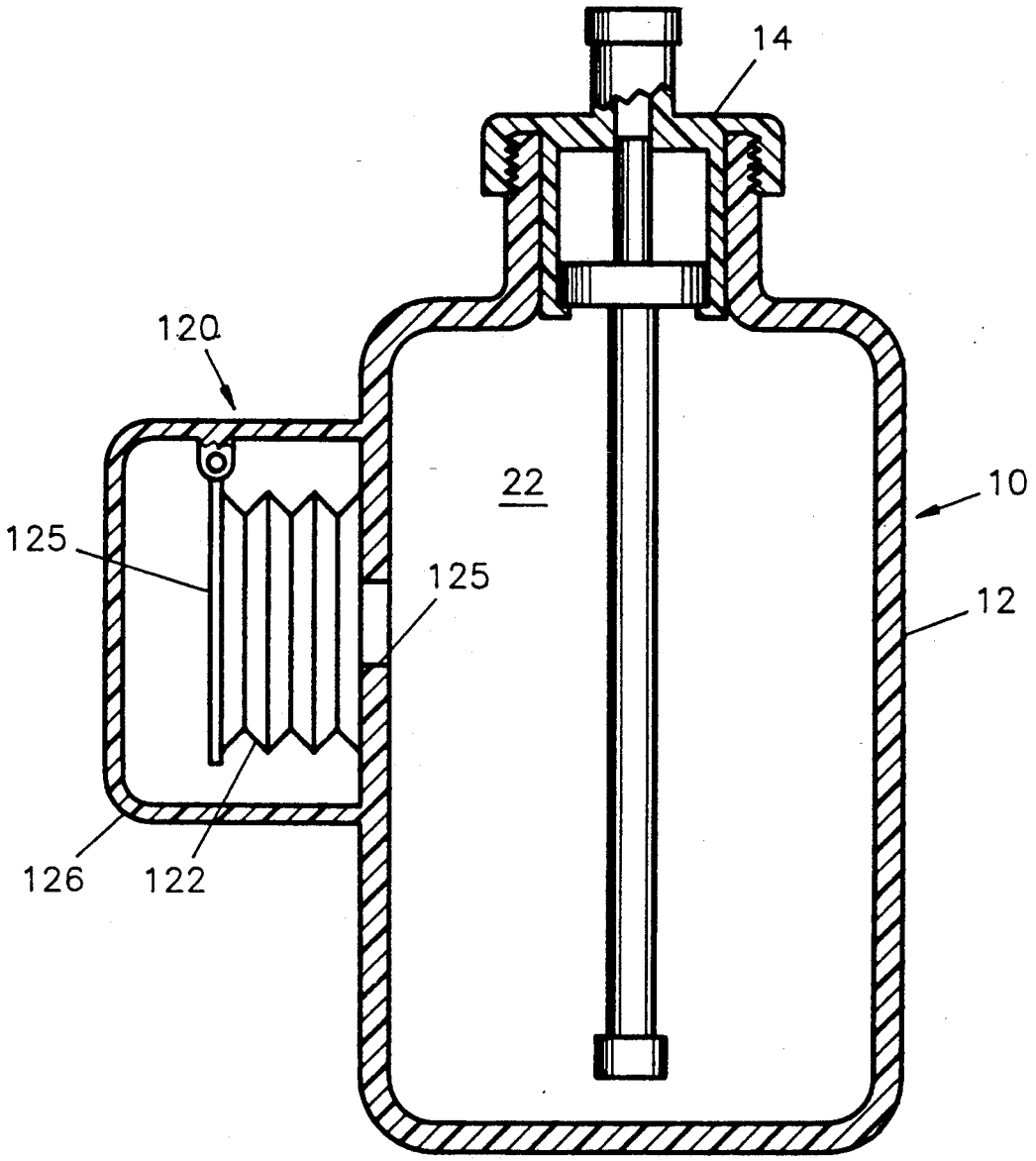
FIG. 6 is an overall cross-sectional view of one embodiment of the present invention including an alternative assembly for pressurizing the interior of the spray bottle container.

It is envisioned that other types of containers employing alternative mechanisms for applying pressure to their contents, such as bellows structures or squeeze triggers arranged for injecting air into the container, may be used in constructing spray bottles in accordance with the present invention. As shown in FIG. 6, an alternative assembly (120) for generating pressure within a spray bottle (10) is attached to the side of the rigid container (12). The assembly (120) includes a bellows structure (122), the interior of which is in communication with the interior (22) of the container (12) through a port (125). The bellows (122) may be compressed by squeezing a trigger (125) hinged on a guard structure (126) and a pressurized air may thereby be injected into the container (12). Force applied to the trigger (125) accordingly results in an increase in pressure within the container (12) as required for operation of the dispensing pump (14) associated with the container (12).

It may also be apparent to those skilled in the art that not only free-flowing liquids can comprise the container contents, but also various other fluid materials such as fine powders or solids entrained in liquids, gases or solutions or viscous liquids. In particular, the fluids which may be functional in the present invention include fluid slurries and solutions such as soaps and deodorants and other similar consumer products. The effectiveness of the present invention and the simplicity of its design make devices such as the spray bottle (10) shown in FIG. 1 commercially viable replacements for many conventional type aerosol cans using fluorocarbon propellants.

It should also be noted that the various fluids usable within the spray bottle of the present invention may be converted through the action of the dispensing pump (14) into different types of "media" of varying descriptions such as mists, fogs, aerosols, fluid streams, and sprays of diverse patterns.

With the present invention in hand, it should be readily apparent to those skilled in this art that the single cylinder or bellows embodiments of, for instance, FIGS. 2 and 4, may be supplemented with one or more additional pressure multiplying means or spray-enhancing means. By way of example, one or more additional parallel or coaxial cylinders and pistons can be added to the embodiment of FIG. 2, or one or more additional bellows may be added to the embodiment of FIG. 4. Alternatively, the additional pressure chamber (either the piston or bellows) may be combined with a dissimilar pressure chamber, e.g., an additional bellows, may be fitted coaxially about the piston (30) of FIG. 3.

Figure 7:
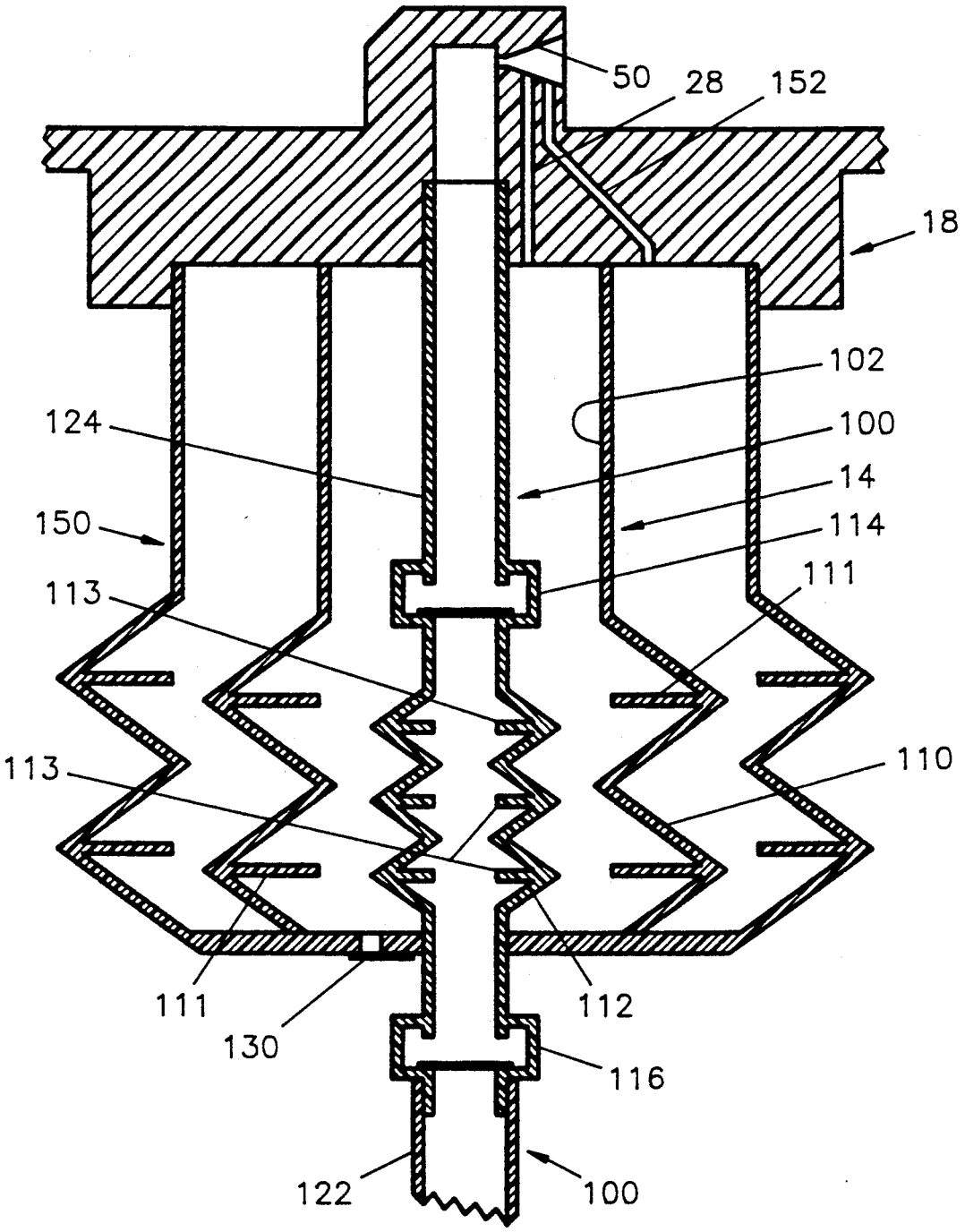
FIG. 7 is a cross-sectional view of an alternative embodiment of the dispensing pump of FIG. 4.

By way of example, the apparatus of FIG. 4 can be modified with an additional coaxial bellows (150), as illustrated in FIG. 7, positioned outside the inner bellows (110). This additional bellows (150) is provided with a vent tube (152) intersecting the nozzle (50) adjacent the vent tube (28), and in fluid communication with outside ambient air. The bellows (150) will thus pump air under pressure into the nozzle (50) to further disperse fluid exiting the nozzle (50). The maximum pressure of the air exiting bellows (150) is determined by the relative areas of the coaxial bellows members (14 and 150). Of course, the outer bellows (150) may be adapted to dispense a fluid other than air (a "disparate fluid"); for example, a fluid contained within the bellows (150) which is to be mixed with the fluid exiting supply tube (100). For the purposes of these additional embodiments, the "additional fluid" can be any liquid, powder, gel, etc., which is to be mixed with the primary fluid within bottle (10).

Figure 8:
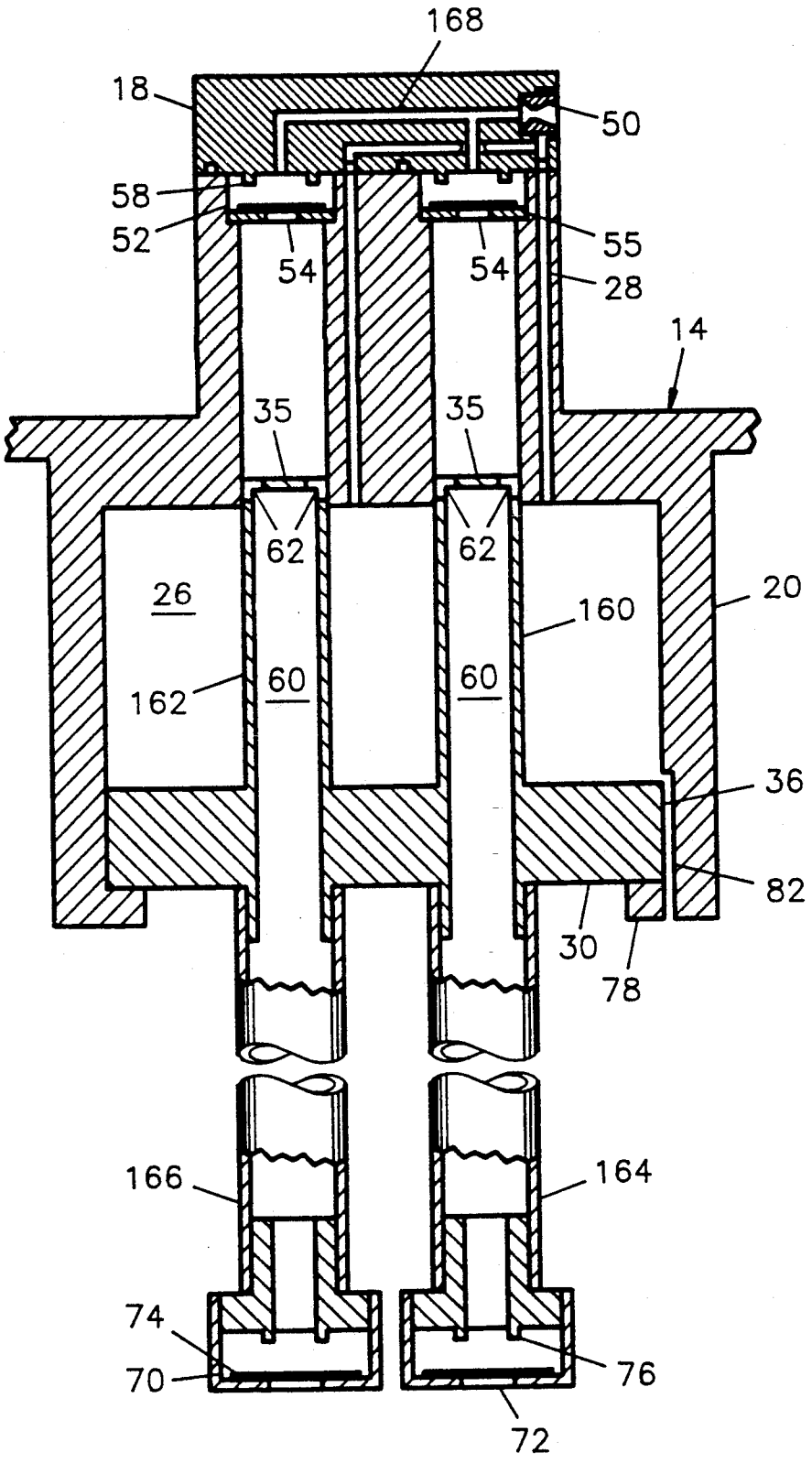
FIG. 8 is a cross-sectional view of an alternative embodiment of the dispensing pump of FIG. 2.

Another embodiment is illustrated in FIG. 8, wherein a pair of pistons (160, 162) are mounted to the hydraulic assembly (30). Each of the pistons (160, 162) are provided with supply tubes (164, 166) in the same manner as that of FIG. 2. The supply tubes may be positioned within reservoirs (not shown) containing disparate fluids such that when the bottle (10) is squeezed, the disparate fluids exit the pistons (160, 162) and are mixed either in a common passageway (168), or in a nozzle (50). In all other respects, the apparatus of FIG. 8 may be constructed the same as that illustrated in FIG. 2. It is to be appreciated that any number of pistons can be arranged adjacent one other as in FIG. 8, or they can be arranged in coaxial configuration as is illustrated with bellows in FIG. 7.

It may further be apparent to those skilled in the art that a combination of pistons and bellows may offer advantages for particular applications. The spring action of a bellows may assist the resilient container (12) in quickly restoring the container (12) to an unsqueezed position, while a piston for the high pressure chamber (24) resists clogging. Internal bellows and external pistons may also offer advantages.

The disparate fluids used herein may be many different fluids which are preferentially maintained in separate and distinct containers prior to mixing at nozzle (50). By way of example only, such fluids may include a foaming agent and a carrier, a polymer, and a hardening agent, etc.

While a preferred embodiment of the present invention has been shown and described, it will be apparent to those skilled in the art that many changes and modifications may be made without departing from the invention in its broader aspects. For example, the dispensing pump (14) may be mounted within the container (12) at or below the level of the fluid residing therein. The appended claims are therefore intended to cover all such changes and modifications as fall within the true spirit and scope of the invention.

We claim:

1. A spray bottle adapted for holding at least one fluid and producing a media of this fluid upon being squeezed, said spray bottle comprising:

(a) a fluid spray discharge member including a spray nozzle;

(b) a container for holding said at least one fluid within its interior, said container having a stiff portion and a resilient portion proportioned and arranged to permit deformation of said resilient portion while preserving an orientation of said fluid spray discharge member;

(c) a housing constructed and arranged for being mounted on said container, said housing including;

at least one high pressure chamber in controlled communication with said spray nozzle and a fluid within said container, and at least one low pressure chamber in communication with the atmosphere outside said container;

(d) at least one dispensing pump constructed and arranged to drive said fluid out through said nozzle at high pressure including:

a first fluid displacer which is mounted in said high pressure chamber for applying pressure to any fluid within this chamber, and a second fluid displacer of greater diameter than said first fluid displacer, which is mounted in said low pressure chamber so as to partition this chamber off from the interior of said container and which is rigidly connected to said first fluid displacer so as to be movable therewith, said hydraulic assembly being operative for being displaced within said low pressure chamber when said bottle is squeezed; and (e) valve means for controlling the transfer of fluid into and out of said at least one high pressure chamber so that fluid will flow out of said high pressure chamber through said nozzle when said bottle is squeezed and flow into said chamber from the interior of said container as said bottle recovers from being squeezed.

2. The spray bottle apparatus of claim 1, wherein the dispensing pump comprises a hydraulic assembly having at least one piston and cylinder within said housing.

3. The spray bottle apparatus of claim 1, wherein the first and second fluid displacers each comprise at least one bellows within said housing.

4. A spray bottle adapted for holding a fluid within its interior and producing a media of this fluid upon being squeezed, said spray bottle comprising:

(a) a first chamber having a fluid spray discharge member including a spray nozzle at one end thereof;

(b) a container for holding said at least one fluid within its interior, said container having a stiff portion and a resilient portion proportioned and arranged to permit deformation of said resilient portion while preserving an orientation of said fluid spray discharge member;

(c) at least one piston means for driving fluid through said chamber and out through said nozzle;

(d) means for applying mechanical force to said at least one first piston means which is generated in response to the pressure inside said container as it is squeezed so that a hydraulic advantage may be achieved with respect to the pressure inside said chamber; and (e) valve means for controlling the supply of said fluid into said first chamber.

5. The spray bottle apparatus of claim 4, wherein said at least one piston means comprise at least two piston means interconnected to separate fluid sources containing disparate fluids.

6. The spray bottle of claim 5, wherein said disparate fluids are mixed upon ejection from the piston means.

7. A spray bottle adapted for holding a fluid and producing a media of this fluid upon being squeezed, said spray bottle comprising:

(a) a fluid spray discharge member including a spray nozzle;

(b) a container for holding said at least one fluid within its interior, said container having a stiff portion and a resilient portion proportioned and arranged to permit deformation of said resilient portion while preserving an orientation of said fluid spray discharge member;

(c) at least one first bellows mounted inside of said container and the interior of which is in communication with the atmosphere outside said container;

(d) a second bellows of smaller diameter than said at least one first bellows which is mounted inside of and rigidly secured to said first bellows, and the interior of which is in controlled communication with said spray nozzle and the fluid within said container; and (e) valve means for controlling the transfer of fluid into and out of said second bellows so that fluid will flow out of this bellows through said nozzle when said bottle is squeezed, and into said bellows from said container as said bottle recovers from being squeezed.

8. The spray bottle of claim 7, wherein the said at least one first bellows are arranged coaxially about one another.

9. A spray bottle adapted for holding a fluid and producing a media of this fluid upon being squeezed, said spray bottle comprising:

(a) a fluid spray discharge member including a spray nozzle;

(b) a container for holding said at least one fluid within its interior, said container having a stiff portion and a resilient portion proportioned and arranged to permit deformation of said resilient portion while preserving an orientation of said fluid spray discharge member;

(c) at least two bellows mounted inside of said container, the interior of each of said bellows being in communication with the atmosphere outside said container;

(d) valve means for controlling the transfer of fluid into and out of said bellows so that fluid will flow out of said bellows and be mixed at the nozzle when said bottle is squeezed and into said bellows from said container as said bottle recovers from being squeezed.

* * * * *

UNITED STATES PATENT AND TRADEMARK OFFICE

CERTIFICATE OF CORRECTION

PATENT NO. : 5,289,948

DATED : March 1, 1994

INVENTOR(S) : Moss et al

It is certified that error appears in the above-indentified patent and that said Letters Patent is hereby corrected as shown below: On the title page: Item [56]

under U.S. PATENT DOCUMENTS, the date "7/1987 " should be replaced with this date --7/1967--, written by Raypholtz .

In column 3, line 31, after the word "FIG.", please insert the number --1--.

In column 7, line 20, after the phrase "about 10-15 to" please insert the number --1--.

Signed and Sealed this

Nineteenth Day of August, 1997

*Attest:*

Bruce Lehman

BRUCE LEHMAN

*Attesting Officer*

*Commissioner of Patents and Trademarks*